US011402796B2

(12) United States Patent
Wang

(10) Patent No.: US 11,402,796 B2
(45) Date of Patent: Aug. 2, 2022

(54) DEVELOPING CARTRIDGE INCLUDING DEVELOPING ROLLER TO CONTACT PHOTOSENSITIVE DRUM AND IMAGE FORMING APPARATUS INCLUDING THE SAME

(71) Applicant: BROTHER KOGYO KABUSHIKI KAISHA, Nagoya (JP)

(72) Inventor: Yuwen Wang, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/891,533

(22) Filed: Jun. 3, 2020

(65) Prior Publication Data

US 2020/0401076 A1 Dec. 24, 2020

(30) Foreign Application Priority Data

Jun. 20, 2019 (JP) ..... JP2019-114857

(51) Int. Cl.
*G03G 21/16* (2006.01)
*G03G 21/18* (2006.01)

(52) U.S. Cl.
CPC ..... *G03G 21/1676* (2013.01); *G03G 21/1652* (2013.01); *G03G 21/1821* (2013.01);
(Continued)

(58) Field of Classification Search
CPC ..... G03G 21/1676; G03G 2221/1684; G03G 21/1647; G03G 21/1652; G03G 21/1842
See application file for complete search history.

(56) References Cited

U.S. PATENT DOCUMENTS

2009/0269097 A1 10/2009 Hashimoto
2010/0166453 A1 7/2010 Okabe
(Continued)

FOREIGN PATENT DOCUMENTS

EP 3 571 550 A1 11/2019
JP 2011-059510 A 3/2011
(Continued)

OTHER PUBLICATIONS

Partial European Search Report issued in corresponding European Patent Application No. 20178509.4, dated Nov. 3, 2020.
(Continued)

*Primary Examiner* — Jessica L Eley
(74) *Attorney, Agent, or Firm* — Merchant & Gould P.C.

(57) ABSTRACT

A developing cartridge for use with a drawer including a photosensitive drum and an electric terminal. The developing cartridge includes a casing, a developing roller, a storage medium and a holder. The casing is configured to accommodate developing agent therein. The developing roller is rotatable about an axis extending in a first direction. The developing roller is movable with the casing. The storage medium has an electrical contact surface. The holder holds the electrical contact surface and is movable with the casing. The casing is movable relative to the drawer in accordance with movement of the drawer from a first position in which developing roller is separated from the photosensitive drum and the electrical contact surface is separated from the electric terminal to a second position in which the developing roller is in contact with the photosensitive drum and the electrical contact surface is in contact with the electric terminal.

35 Claims, 10 Drawing Sheets

(52) U.S. Cl.
CPC ..... *G03G 2221/1684* (2013.01); *G03G 2221/1869* (2013.01)

(56) References Cited

U.S. PATENT DOCUMENTS

| | | | | |
|---|---|---|---|---|
| 2011/0064457 | A1 | 3/2011 | Okabe et al. | |
| 2013/0051849 | A1 | 2/2013 | Itabashi et al. | |
| 2014/0093273 | A1* | 4/2014 | Hayakawa | G03G 21/18 399/111 |
| 2014/0294425 | A1* | 10/2014 | Okabe | G03G 21/1871 399/110 |
| 2014/0294439 | A1* | 10/2014 | Kawahara | G03G 21/1623 399/119 |
| 2016/0259294 | A1* | 9/2016 | Sakamoto | G03G 21/1609 |
| 2017/0184998 | A1* | 6/2017 | Itabashi | G03G 21/1652 |
| 2017/0269546 | A1* | 9/2017 | Yokoi | G03G 21/1814 |
| 2018/0095416 | A1* | 4/2018 | Nishiyama | G03G 21/1652 |
| 2019/0302641 | A1 | 10/2019 | Wang et al. | |
| 2019/0302645 | A1 | 10/2019 | Wang et al. | |
| 2019/0302674 | A1 | 10/2019 | Wang et al. | |

FOREIGN PATENT DOCUMENTS

| | | | |
|---|---|---|---|
| JP | 2013-054058 | A | 3/2013 |
| JP | 2013-125149 | A | 6/2013 |
| JP | 2019-45580 | A | 3/2019 |
| JP | 2019-66577 | A | 4/2019 |
| WO | 2019/187237 | A1 | 10/2019 |

OTHER PUBLICATIONS

Extended European Search Report issued in corresponding European Patent Application No. 20178509.4, dated Mar. 12, 2021.

* cited by examiner

DEVELOPING CARTRIDGE INCLUDING DEVELOPING ROLLER TO CONTACT PHOTOSENSITIVE DRUM AND IMAGE FORMING APPARATUS INCLUDING THE SAME

CROSS REFERENCE TO RELATED APPLICATION

This application claims priority from Japanese Patent Application No. 2019-114857 filed Jun. 20, 2019. The entire content of the priority application is incorporated herein by reference.

TECHNICAL FIELD

The present disclosure relates to a developing cartridge and an image forming apparatus including the developing cartridge.

BACKGROUND

There has been known an electro-photographic type image forming apparatus such as a laser printer and an LED printer. The image forming apparatus includes a drawer, and a plurality of developing cartridges. The drawer includes a plurality of photosensitive drums. Each developing cartridge includes a developing roller. Each developing cartridge is attached to and detached from the drawer. Further, the drawer to which the plurality of developing cartridge is attached is attached to a housing of the image forming apparatus. Japanese Patent Application Publication Nos. 2011-59510 and 2013-54058 disclose such conventional image forming apparatus including the drawer and the plurality of developing cartridges.

In order to attach the developing cartridge to the drawer, a casing of the developing cartridge is initially set at a first position, where the developing roller is out of contact with the photosensitive drum. The casing of the developing cartridge moves from the first position to a second position by pushing the developing cartridge into the drawer. The developing roller contacts the photosensitive drum at the second position.

SUMMARY

In a case where the drawer is attached to the housing while the casing of the developing cartridge is still at the first position, developing agent cannot be supplied from the developing roller to the photosensitive drum since the developing roller is out of contact with the photosensitive drum.

In view of the foregoing, it is an object of the disclosure to provide a developing cartridge and an image forming apparatus capable of moving the developing cartridge to permit the developing roller to contact the photosensitive drum even in a case where the drawer is attached to the housing while the developing roller is separated from the photosensitive drum.

In order to attain the above and other objects, according to one aspect, the disclosure provides a developing cartridge for use with a drawer including a photosensitive drum and an electric terminal. The developing cartridge includes a casing, a developing roller, a storage medium and a holder. The casing is configured to accommodate developing agent therein. The developing roller is rotatable about an axis extending in a first direction. The developing roller is movable with the casing. The storage medium has an electrical contact surface. The holder holds the electrical contact surface. The holder is movable with the casing. The casing is movable relative to the drawer in accordance with movement of the drawer from a first position in which developing roller is separated from the photosensitive drum and the electrical contact surface is separated from the electric terminal to a second position in which the developing roller is in contact with the photosensitive drum and the electrical contact surface is in contact with the electric terminal.

According to another aspect, the disclosure provides a developing cartridge for use with a drawer including a frame and a photosensitive drum. The developing cartridge includes a casing, ad developing roller and a separation cam. The casing is configured to accommodate developing agent therein. The developing roller is rotatable about an axis extending in a first direction. The developing roller is movable with the casing. The separation cam is movable in the first direction relative to the casing. The separation cam is movable together with the casing relative to the photosensitive drum in a direction crossing the first direction. The casing is movable relative to the drawer in accordance with movement of the drawer from a first position in which developing roller is separated from the photosensitive drum and the separation cam is in contact with a frame of the drawer to a second position in which the developing roller is in contact with the photosensitive drum and the separation cam is separated from the frame of the drawer.

According to still another aspect, the disclosure provides a developing cartridge for use with a drawer including a photosensitive drum. The developing cartridge includes a casing, a developing roller and a first boss. The casing is configured to accommodate developing agent therein. The developing roller is rotatable about an axis extending in a first direction, the developing roller being movable with the casing. The first boss extends in the first direction. The drawer has a support surface configured to allow the first boss to be seated and configure to receive a weight of the developing cartridge. The casing is pivotally movable about the first boss relative to the drawer in accordance with movement of the drawer from a first position in which developing roller is separated from the photosensitive drum and the first boss is in contact with the support surface to a second position in which the developing roller is in contact with the photosensitive drum.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, a general structure of an image-forming apparatus 100 according to one embodiment will be descried with reference to FIG. 1.

1. Structure of Image Forming Apparatus

Figure 1:
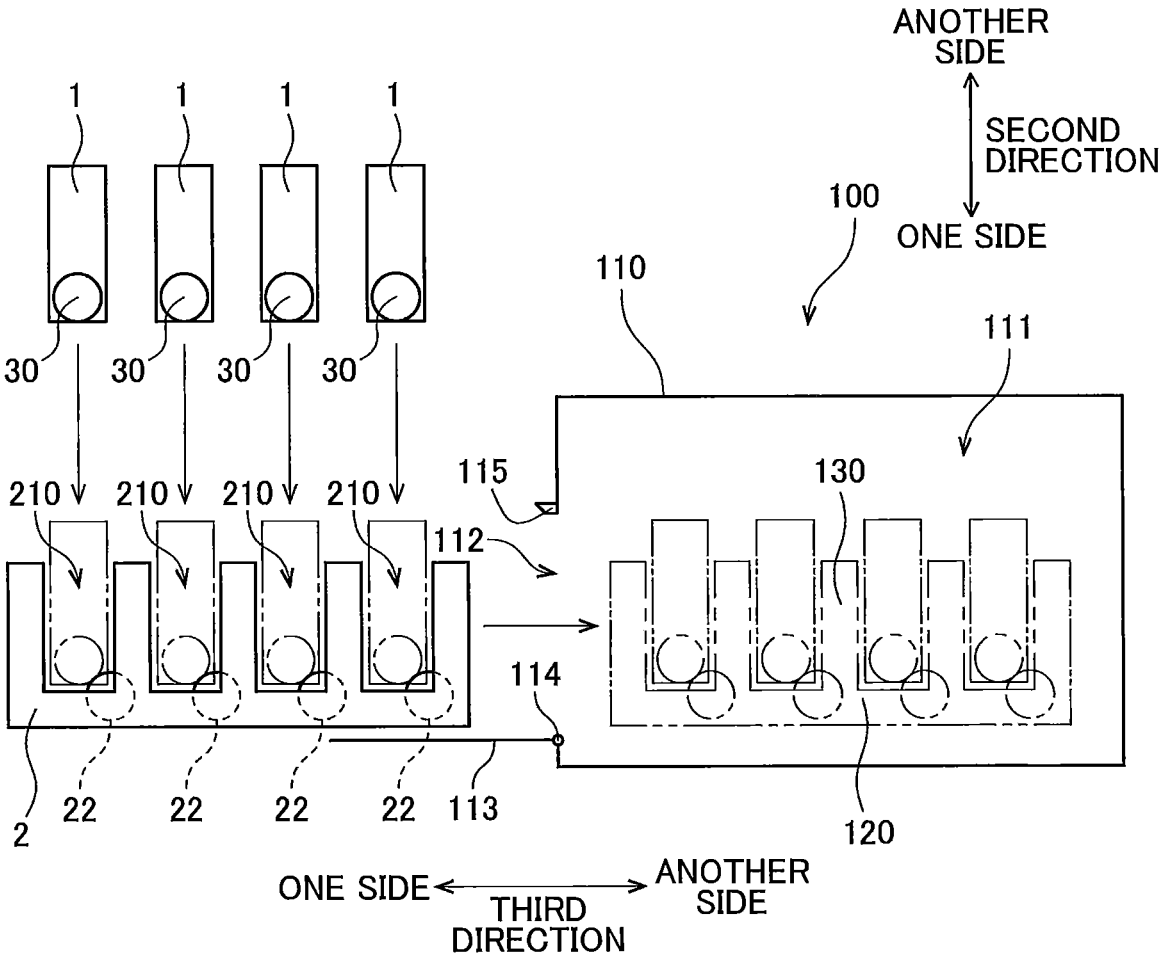
FIG. 1 is a schematic view illustrating an image forming apparatus according to one embodiment.

FIG. 1 is a schematic view illustrating the image forming apparatus 100. The image-forming apparatus 100 is an electro-photographic type printer, such as a laser printer and an LED printer, and includes four developing cartridges 1, a drawer 2, and a housing 110.

Each of the developing cartridges 1 is attachable to and detachable from the drawer 2. Further, the drawer to which the four developing cartridges 1 are attached is attachable to and detachable from the housing 110. The four developing cartridges 1 accommodate therein developing agents (toners) of different colors (for example, cyan, magenta, yellow and black), respectively. An image is formed on a sheet with the developing agent supplied from each developing cartridge 1. Incidentally, the number of developing cartridges 1 may be from one to three or not less than five.

As illustrated in FIG. 1, the housing 110 provides an internal space 111 in which the drawer 2 to which the four developing cartridges 1 are attached is accommodatable. The housing 110 has an insertion opening 112 and includes a front cover 113. The front cover 113 is movable between a closed position for closing the insertion opening 112 and an open position for opening the insertion opening 112. Specifically, the front cover 113 is pivotally movable between the closed position and the open position about a hinge 114 extending in a first direction. The insertion opening 112 is defined by a pair of edges arrayed with each other in a second direction crossing the first direction. The hinge 114 is positioned at one of the edges (lower edge).

The drawer 2 to which the four developing cartridges 1 are attached is movable in a third direction from an outside of the housing 110 to the internal space 111 of the housing 110 through the insertion opening 112. The third direction intersects with the first and second directions.

Figure 7:
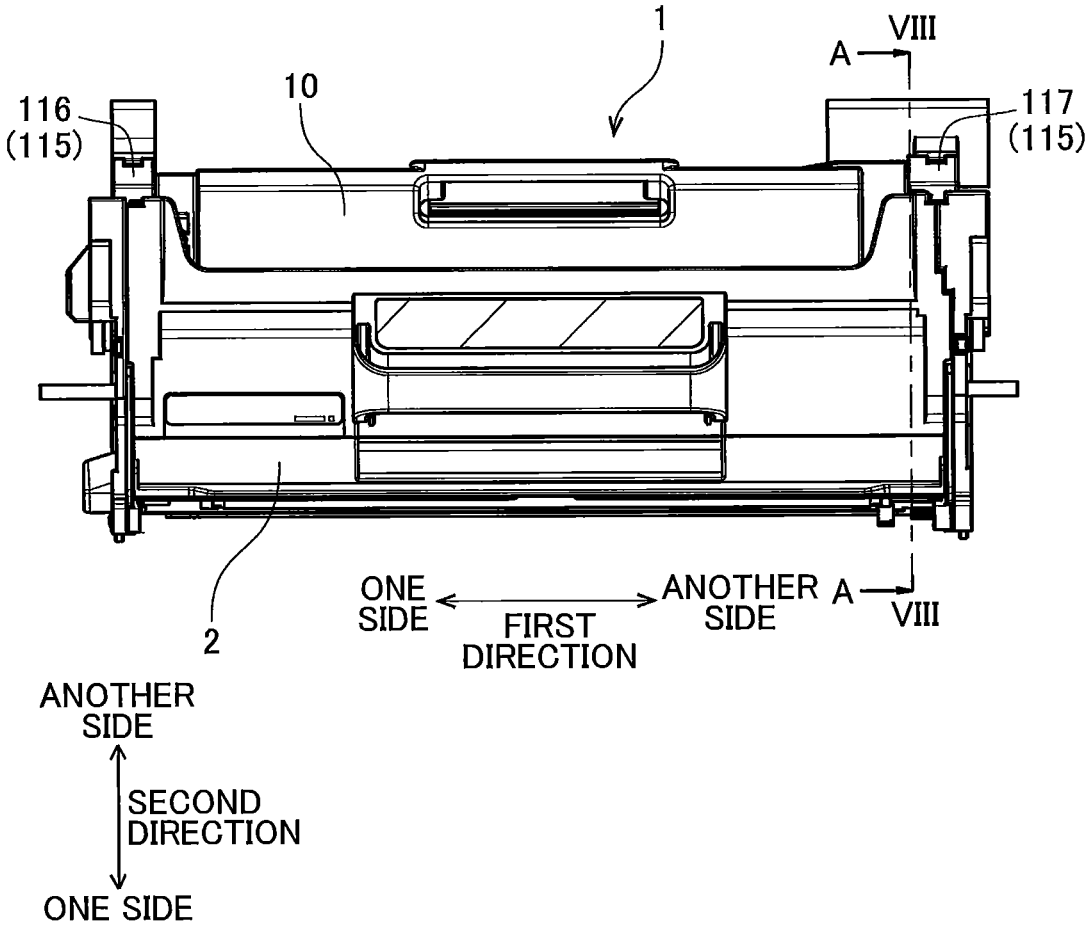
FIG. 7 is a view of the four developing cartridges, the drawer and the pressure portion those illustrated in FIG. 5 and as viewed from one side in a third direction.

Further, the housing 110 is provided with a pressure portion 115 positioned at remaining one of the edges (upper edge) of the insertion opening 112. That is, the pressure portion 115 is positioned opposite to the hinge 114 in the second direction with respect to the pair of edges. The pressure portion 115 protrudes outward of the housing 110 from the edge of the insertion opening 112 in the third direction toward one side. As illustrated in FIG. 7, the pressure portion 115 includes a first pressure portion 116 and a second pressure portion 117 spaced away from the first pressure portion 116 in the first direction.

2. Drawer

Figure 2:
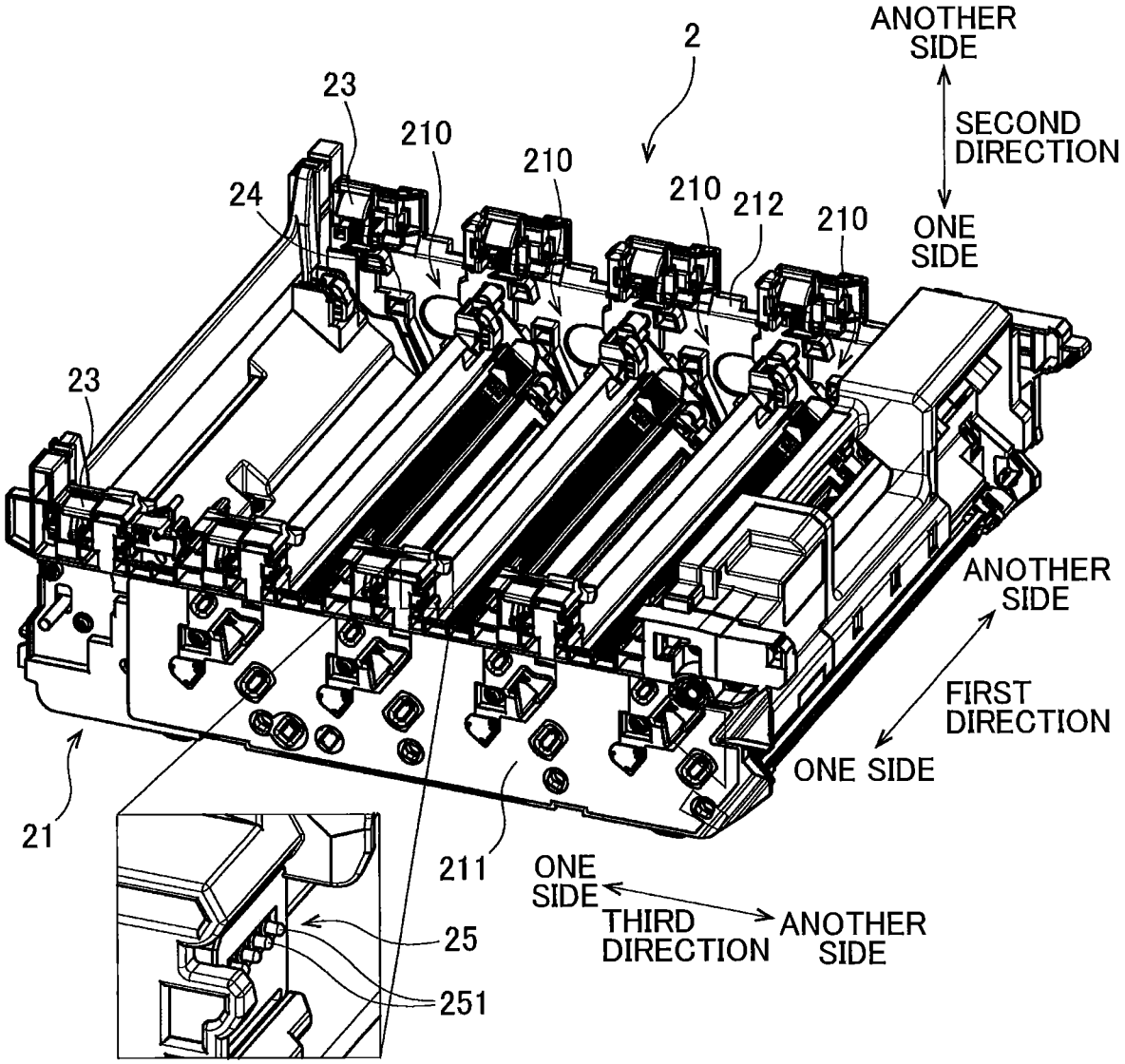
FIG. 2 is a perspective view of a drawer in the image forming apparatus according to the embodiment.

FIG. 2 is a perspective view of the drawer 2. As illustrated in FIGS. 1 and 2, the drawer 2 includes a drawer frame 21, four photosensitive drums 22, eight lock levers 23, and four electric connectors 25. The drawer 2 has eight support surfaces 24.

Figure 6:
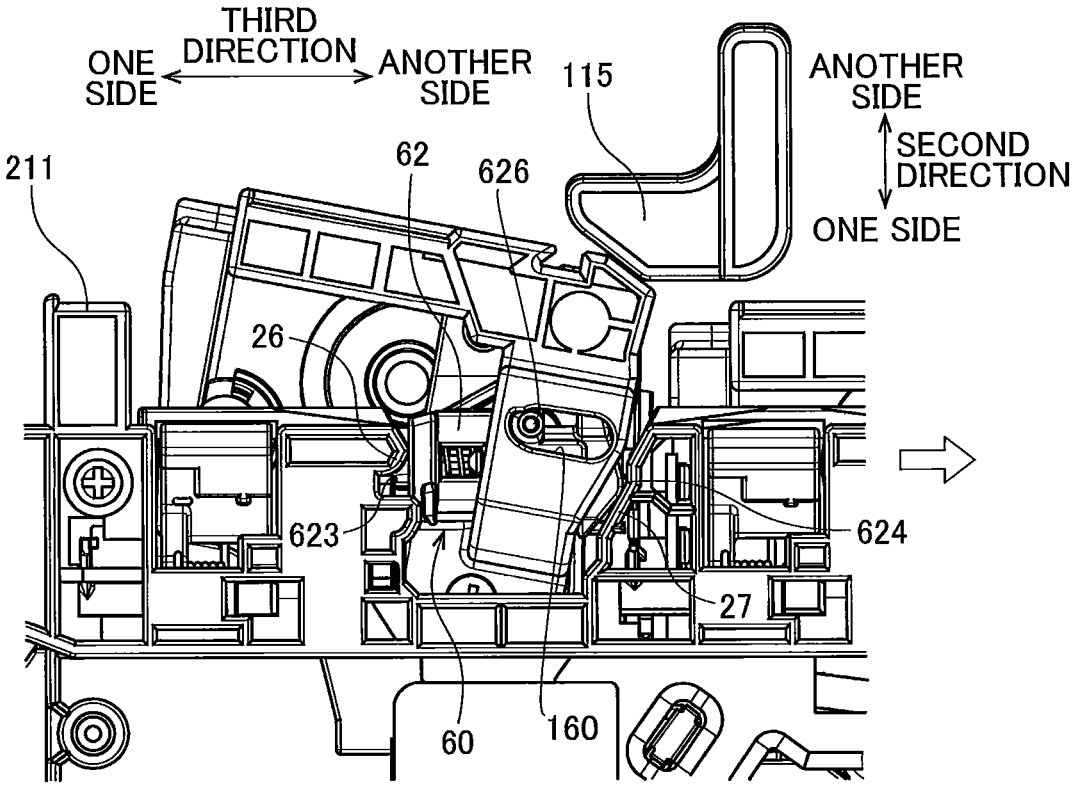
FIG. 6 is an enlarged view of a portion in FIG. 5 encircled by broken line.

The drawer frame 21 includes a first side frame 211 and a second side frame 212 spaced away from the first side frame 211 in the first direction. The first side frame 211 and second side frame 212 both extend in a direction perpendicular to the first direction. The four holding portions 210 are provided each at a position between the first side frame 211 and the second side frame 212. Each developing cartridge 1 is attachable to a corresponding one of the holding portions 210. As illustrated in FIG. 6, the first side frame 211 has a first guide surface 26 and a second guide surface 27 facing the first guide surface 26 in the third direction.

Each photosensitive drum 22 is provided for a corresponding one of the holding portions 210. Each of the photosensitive drums 22 extends in the first direction at a position between the first side frame 211 and the second side frame 212. Each photosensitive drum 22 is rotatable about an axis extending in the first direction. Each photosensitive drum 22 has a cylindrical outer peripheral surface extending in the first direction. The outer peripheral surface is a surface coated with a photosensitive material. Upon attachment of the developing cartridge 1 to the holding portion 210, an outer peripheral surface of a developing roller 30 (described later) of the developing cartridge 1 contacts the outer peripheral surface of the photosensitive drum 22. In the attached state of the drawer 2 to the housing 10, an axis of the developing roller 30 extends in the first direction.

Incidentally, the drawer 2 may have one to three holding portions 210, or not less than five holding portions 210. That is, the drawer 2 may include one to three photosensitive drums 22, or not less than five photosensitive drums 22.

Each lock lever 23 is configured to urge each developing cartridge 1 toward a second position described later. Four lick levers 23 are positioned at the first side frame 211, and remaining four lock levers 23 are positioned at the second side frame 212. In the drawer 2, a single lock lever 23 positioned at the first side frame 211 and a single lock lever 23 positioned at the second side frame 212 are provided with respect to each holding portion 210.

Each lock lever 23 is pivotally movable about an axis of a pivot shaft 23A (FIG. 9) extending in the third direction. Specifically, each lock lever 23 is pivotally movable between a lock position and a releasing position where the lock lever 23 protrudes more outward of the drawer frame 21 in the first direction than the lock lever 23 in the lock position. Further, a resilient urging member 23B (FIG. 9) such as a torsion spring is provided at the drawer 2 for urging each lock lever 23 toward the lock position. A coil spring or a leaf spring is also available as the urging member.

Each support surface 24 is configured to be applied with a weight of the developing cartridge 1 attached to the holding portion 210. Four support surfaces 24 are positioned at an inner surface of the first side frame 211. Remaining four support surfaces 24 are positioned at an inner surface of the second side frame 212. In the drawer 2, a single side surface 24 positioned at the first side frame 211 and a single side frame 24 positioned at the second side frame 212 are provided with respect to each holding portion 210. Each support surface 24 extends in a direction perpendicular to the second direction.

Each electric connector 25 is configured to be electrically connected to an IC chip 61 (FIG. 4, described later) of an IC chip assembly 60 (described later) of the developing cartridge 1. Four electric connectors 25 are positioned at the first side frame 211. In the drawer 2, each electric connector 25 is provided for each holding portion 210. As illustrated in enlarged view in FIG. 2, the electric connector 25 includes a plurality of electric terminals 251, each made from electrically conductive material such as metal.

3. Developing Cartridge

Figure 3:
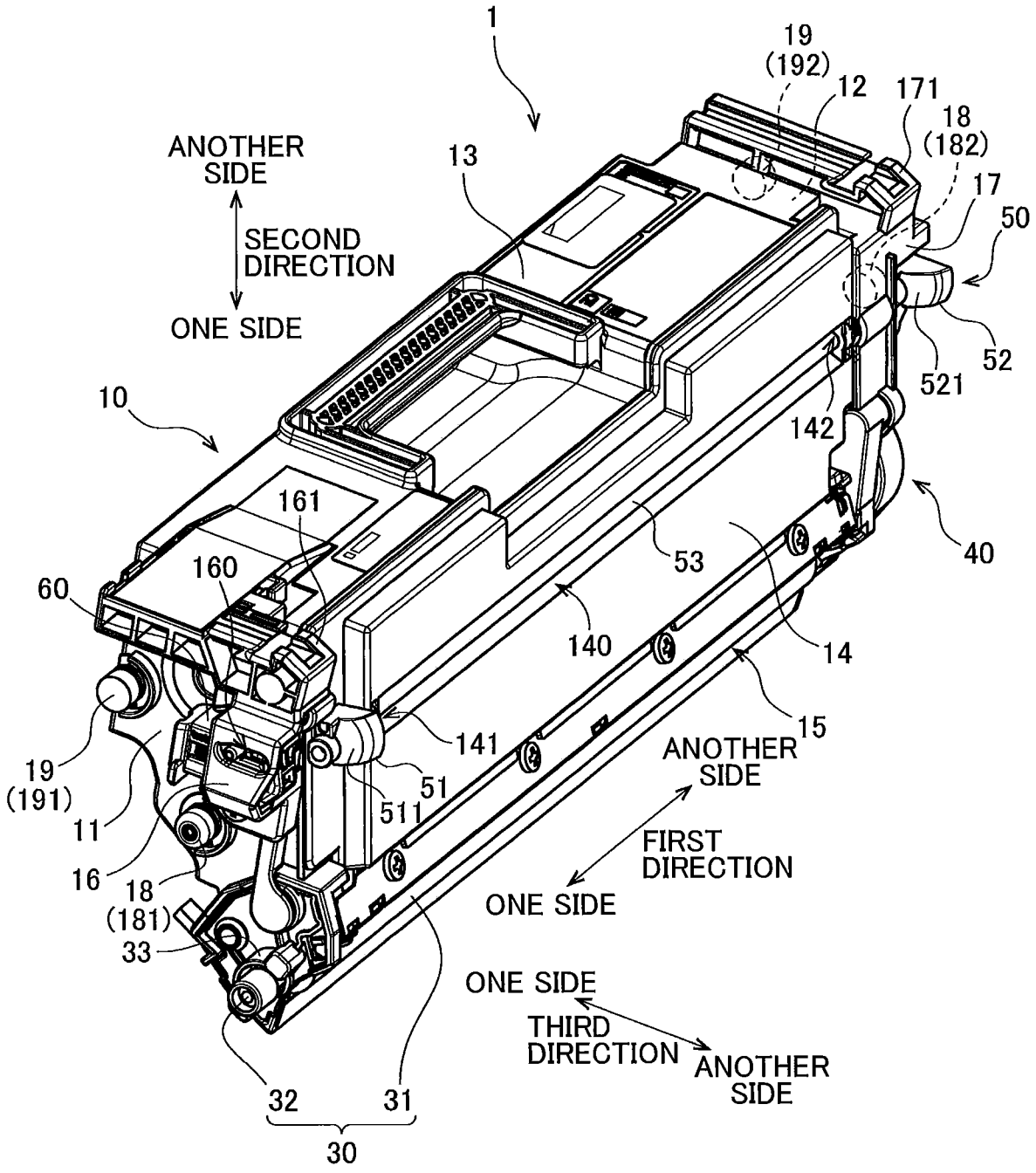
FIG. 3 a perspective view of a developing cartridge according to the embodiment.

FIG. 3 a perspective view of the developing cartridge 1. As illustrated in FIG. 3, the developing cartridge 1 includes a case 10, the developing roller 30, a gear portion 40, a separation cam 50, and the IC chip assembly 60.

The case 10 is configured to accommodate therein the developing agent. The case 10 has a first outer surface 11 and a second outer surface 12 spaced away from each other in the first direction. The first outer surface 11 is positioned at one end in the first direction of the case 10, and the second outer surface 12 is positioned at another end in the first direction of the case 10. The case 10 includes a container portion 13 and a lid portion 14. The container portion 13 has the first outer surface 11 and the second outer surface 12. The developing agent is accommodated in an interior of the container portion 13. The interior of the container portion 13 is covered by the lid portion 14. The case 10 has an opening 15 positioned at one end portion in the second direction of the case 10. An interior of the case 10 is communicable with an outside of the case 10 through the opening 15.

The developing cartridge 1 further includes a first cover 16 and a second cover 17. The first cover 16 is fixed to the first outer surface 11 by, for example, a screw. At least a portion of the first outer surface 11 is covered with the first cover 16. As illustrated in FIG. 3, the first cover 16 is formed with an opening 160 extending in the third direction. The opening 160 extends throughout the thickness of the first cover 16 in the first direction. The second cover 17 is fixed to the second outer surface 12 by, for example, a screw. At least a portion of the second outer surface 12 is covered with the second cover 17. The first cover 16 and the second cover 17 constitute a casing in combination with the case 10.

The first cover 16 has an outer surface at another side in the second direction as a first pressure receiving surface 161. The second cover 17 has an outer surface at another side in the second direction as a second pressure receiving surface 171. The first pressure receiving surface 161 and the second pressure receiving surface 171 are configured to be aligned with the first pressure portion 116 and the second pressure portion 117, respectively in accordance with the movement of the drawer 2. The first pressure receiving surface 161 is positioned forward of a center of the case 10 in the first direction toward one side. The second pressure receiving surface 171 is positioned backward of the center of the case 10 in the first direction toward the one side. A direction for connecting the developing roller 30 to the first pressure receiving surface 161 (or to the second pressure receiving surface 171) is the second direction.

The case 10 further includes two first bosses 18, and two second bosses 19. The two first bosses 18 are protrusions contactable with the support surfaces 24 when the developing cartridge 1 is attached to the drawer 2. The two second bosses 19 are protrusions contactable with the lock levers 23 during a process of attaching the developing cartridge 1 to the drawer 2.

As illustrated in FIG. 3 one of the two first bosses 18 (hereinafter simply referred to as a first boss 181) is positioned at the first outer surface 11, and remaining one of the two first bosses 18 (hereinafter simply referred to as a first boss 182) is positioned at the second surface 12. Further, one of the two second bosses 19 (hereinafter simply referred to as a second boss 191) is positioned at the first outer surface 11, and remaining one of the two second bosses 19 (hereinafter simply referred to as a second boss 192) is positioned at the second surface 12.

The first boss 181 extends in the first direction toward the one side from the first outer surface 11 or the first cover 16. The first boss 182 extends in the first direction toward another side from the second outer surface 12 or the second cover 17. The second boss 191 extends in the first direction toward the one side from the first outer surface 11 or the first cover 16. The second boss 192 extends in the first direction toward another side from the second outer surface 12 or the second cover 17. The second bosses 191, 192 are positioned farther from the developing roller 30 than the first bosses 181, 182 is from the developing roller 30.

The developing roller 30 is positioned at the opening 15 of the case 10. That is, the developing roller 30 is positioned at one end portion in the second direction of the case 10. The developing roller 30 is movable along with the case 10. Further, the developing roller 30 is rotatable about an axis extending in the first direction.

The developing roller 30 includes a developing roller body 31 and a developing roller shaft 32. The developing roller body 31 is hollow cylindrical in shape and extends in the first direction. The developing roller body 31 is made from elastic material such as rubber. The developing roller shaft 32 is a solid cylindrical member penetrating through the developing roller body 31 in the first direction. The developing roller shaft 32 is made from metal or electrically conductive resin. The developing roller body 31 has an outer peripheral surface portion exposed to the outside of the case 10 through the opening 15. Remaining outer peripheral surface portion of the developing roller body 31 is positioned inside the case 10. The developing roller body 31 is fixed to the developing roller shaft 32 without relative rotation. That is, the developing roller body 31 is rotatable together with the developing roller shaft 32.

Each developing cartridge 1 further includes a developing electrode 33. The developing electrode 33 is positioned at the first outer surface 11 of the case 10. One end portion of the developing roller shaft 32 in the first direction is rotatably supported by the developing electrode 33. The developing roller shaft 32 and the developing electrode 33 are electrically connected to each other. The image-forming apparatus 100 is configured to supply a bias voltage to the developing roller shaft 32 through the developing electrode 33.

The developing roller shaft 32 has another end portion in the first direction on which a developing roller gear (not illustrated) is mounted. The developing roller gear is one of a plurality of gears constituting the gear portion 40. The developing roller gear is positioned at the second outer surface 12 of the case 10. The developing roller gear is fixed to the other end portion of the developing roller shaft 32 without relative rotation therebetween. Hence, rotation of the developing roller gear causes the developing roller shaft 32 to rotate, thereby causing the developing roller body 31 to rotate together with the developing roller shaft 32.

Incidentally, the developing roller shaft 32 may not penetrate throughout the developing roller body 31 in the first direction. For example, the developing roller shaft 32 may extend in the first direction from each end in the first direction of the developing roller body 31.

The developing cartridge 1 further includes a supply roller (not illustrated). The supply roller is positioned inside the case 10. The supply roller has an outer peripheral surface in contact with the outer peripheral surface of the developing roller body 31. The supply roller is rotatable about an axis extending in the first direction. Upon receipt of driving force to the developing cartridge 1 from the image forming apparatus 100, the developing roller 30 and the supply roller are caused to rotate. Hence, the developing agent accommodated in the case 10 is supplied to the outer peripheral surface of the developing roller 30 through the supply roller. In this instance, the developing agent is subjected to triboelectric charging between the developing roller 30 and the supply roller. Further, a developing bias voltage is applied to the developing roller shaft 32. Hence, the developing agent is attracted to the outer peripheral surface of the developing roller body 31 because of electrostatic force between the developing roller shaft 32 and the developing agent.

The developing cartridge 1 further includes a layer thickness regulation blade (not illustrated). The layer thickness regulation blade is configured to regulate a thickness of a layer of the developing agent supplied to the outer peripheral surface of the developing roller body 31 into a uniform thickness. Thereafter, the developing agent on the outer peripheral surface of the developing roller body 31 is supplied to the corresponding photosensitive drum 22 of the drawer 2. At this time, the developing agent is transferred from the developing roller body 31 to the photosensitive drum 22 according to an electrostatic latent image formed on the photosensitive drum 22. Thus, the electrostatic latent image becomes a visible image on the outer peripheral surface of the photosensitive drum 22.

The gear portion 40 is positioned at the second outer surface 12 of the case 10. Specifically, the gear portion 40 is positioned between the second outer surface 12 and the second cover 17. The gear portion 40 includes a coupling (not illustrated) and the plurality of gears (not illustrated). The plurality of the gears has a portion covered with the second cover 17. The coupling is exposed to the outside through the second cover 17.

The image forming apparatus 100 includes a drive shaft. When the drawer 2 to which the developing cartridge 1 is attached is attached to the housing 110 of the image forming apparatus 100, the drive shaft is inserted into the coupling. Hence, the drive shaft and the coupling are coupled together so as not to rotate relative to each other. Rotation of the drive shaft causes rotation of the coupling, which then causes rotation of the plurality of gears including the developing gear in the gear portion 40. The developing roller 30 and the supply gear thus rotate in accordance with the rotation of the developing gear.

The separation cam 50 is a mechanism configured to move the developing roller 30 between a contacting position where the developing roller 30 is in contact with the corresponding photosensitive drum 22 and a separated position where the developing roller 30 is away from the corresponding photosensitive drum 22 in an attached state of the developing cartridge 1 to the drawer 2. As illustrated in FIG. 3, the separation cam 50 includes the first cam 51, a second cam 52 and a camshaft 53.

The lid portion 14 has an outer surface formed with an elongated groove 140 extending in the first direction. Further, the case 10 is formed with a first through-hole 141, and a second through-hole 142. The first through-hole 141 is positioned at one end of the groove 140, and the second through-hole 142 is positioned at another end of the groove 140.

The camshaft 53 is a rod-like member extending in the first direction, and is positioned in the groove 140. The camshaft 53 has one end portion extending through the first through-hole 141 and positioned further away from the first through-hole 141 toward one side in the first direction. The camshaft 53 has another end portion extending through the second through-hole 142 and positioned further away from the second through-hole 142 toward another side in the first direction.

The first cam 51 is positioned at the first outer surface 11 of the case 10. The first cam 51 is fixed to the one end portion of the camshaft 53. The first cam 51 has a first sloped surface 511. The first sloped surface 511 is inclined with respect to the first direction. Specifically, the first sloped surface 511 is gradually away from the camshaft 53 as advancing in the first direction toward another side. The first sloped surface 511 is formed in only a specific angular range of an outer peripheral surface of the first cam 51, the specific angular range being facing in the third direction. However, the first sloped surface 511 may be formed in an entire outer peripheral surface of the first cam 51.

The second cam 52 is positioned at the second outer surface 12 of the case 10. The second cam 52 is fixed to the other end portion of the camshaft 53. The second cam 52 has a second sloped surface 521. The second sloped surface 521 is inclined with respect to the first direction. Specifically, the second sloped surface 521 is gradually away from the camshaft 53 as advancing in the first direction toward another side. The second sloped surface 521 is formed in only a specific angular range of an outer peripheral surface of the second cam 52, the specific angular range being facing in the third direction. However, the second sloped surface 521 may be formed in an entire outer peripheral surface of the second cam 52.

The first cam 51, the second cam 52, and the camshaft 53 are movable in the second and third directions along with the case 10. Further, the first cam 51, the second cam 52, and the camshaft 53 are movable relative to the case 10 in the first direction. Specifically, the first cam 51, the second cam 52, and the camshaft 53 are movable in the first direction between a third position and a fourth position, the fourth position being forward of the third position in a direction from another side to one side in the first direction.

Further, the separation cam 50 further includes a resilient urging member (not illustrated) such as a coil spring positioned in the second through-hole 142. The resilient urging member is configured to urge the first cam 51, the second cam 52 and the camshaft 53 in a direction from the fourth position toward the third position. Therefore, the first cam 51, the second cam 52 and the camshaft 53 are positioned at the third position, when the case 10 of the developing cartridge 1 is at the second position in a state where no driving force directing toward the one side in the first direction is applied from the image forming apparatus 100 to the second cam 52.

The first cam 51, the second cam 52 and the camshaft 53 are moved from the third position to the fourth position against the urging force of the resilient urging member in accordance with application of driving force directing toward one side in the first direction from the image forming apparatus 100 to the second cam 52 in a state where the position of the case 10 relative to the drawer 2 is at the second position. Hence, the first sloped surface 511 of the first cam 51 and the second sloped surface 521 of the second cam 52 are brought into contact with a portion of the drawer frame 21.

Then, in accordance with further movement of the first sloped surface 511 and the second sloped surface 521 in the first direction toward the one side relative to the drawer frame 21, the first sloped surface 511 and the second sloped surface 521 are moved in the third direction toward the one side relative to the drawer frame 21. As a result, the separation cam 50, the case 10, and the developing roller 30 are moved in the third direction toward the one side relative to the photosensitive drum 22. Consequently, the developing roller 30 is moved from the contacting position to the separated position with respect to the photosensitive drum 22.

Figure 4:
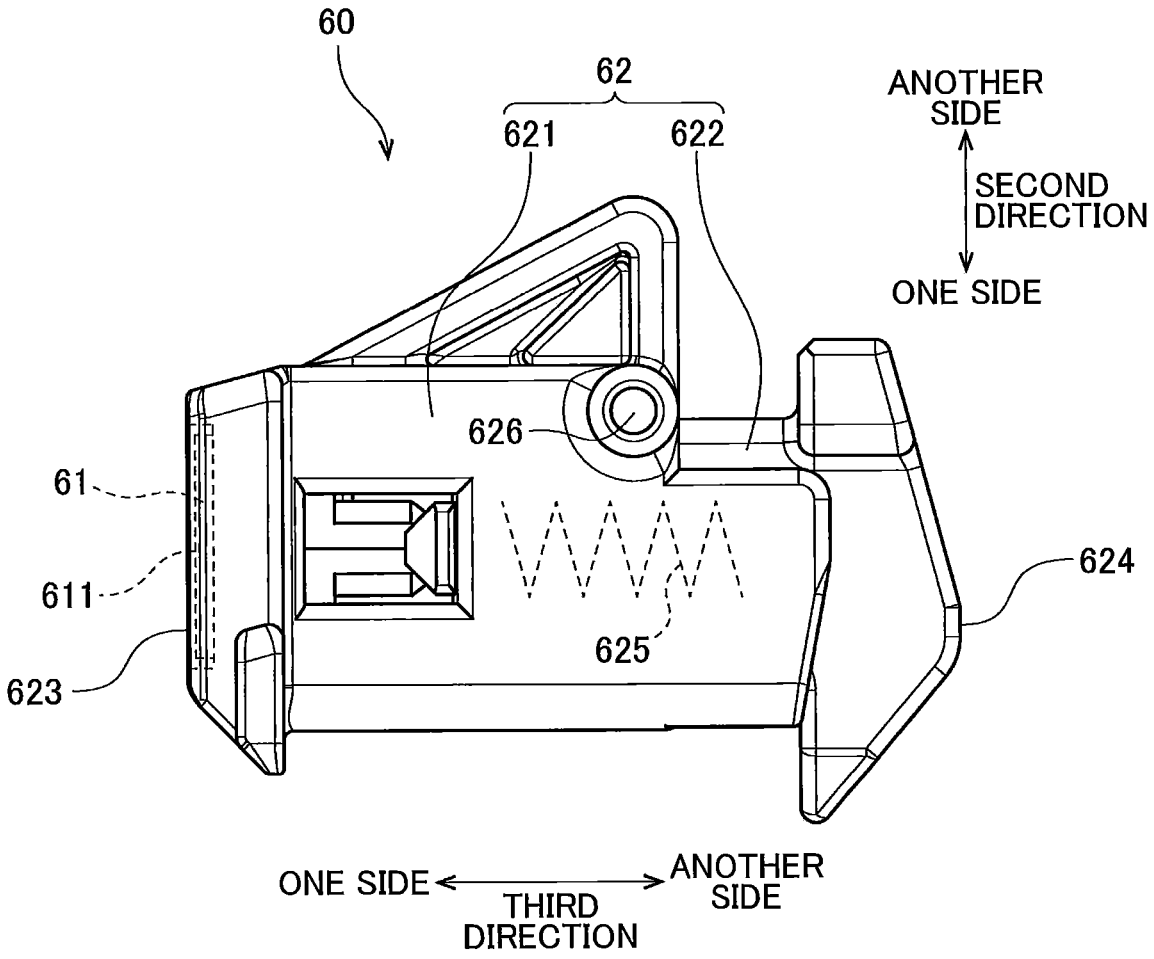
FIG. 4 is a side view illustrating an IC chip assembly provided in the developing cartridge according to the embodiment.

The IC chip assembly 60 is positioned at the first outer surface 11 of the case 10. Specifically, the IC chip assembly 60 is positioned between the first outer surface 11 of the case 10 and the first cover 16. At least a part of the IC chip assembly 60 is covered with the first cover 16. As illustrated in FIG. 4, the IC chip assembly 60 includes the IC chip 61 and a holder 62 holding the IC chip 61.

The IC chip 61 is a storage medium from which data is readable and in which data is writable. The IC chip 61 has an electrical contact surface 611. The electrical contact surface 611 extends perpendicular to the third direction. The electrical contact surface 611 is made from metal having electrical conductivity. Various information on the developing cartridge 1 is stored in the IC chip 61. For example, data selected from at least one of manufacturing serial number of the developing cartridge 1, identification code of the developing cartridge 1 indicative of genuine product, model matching with the developing cartridge 1, specification of the developing cartridge 1, capacity of developing agent, service life of the developing roller 30, numbers of printing sheets, and error history is stored in the IC chip 61.

The holder 62 includes a first holder member 621 and a second holder member 622. The first holder member 621 has a third outer surface 623, which is one end surface of the holder 62 in the third direction. The IC chip 61 is fixed to the third outer surface 623. The second holder member 622 has a fourth outer surface 624, which is another end surface of the holder 62 in the third direction.

The first holder member 621 is movable relative to the second holder member 622 in the third direction. Hence, the third outer surface 623 is movable relative to the fourth outer surface 624 in the third direction. Further, the holder 62 further includes a resilient urging member 625 positioned between the third outer surface 623 and the fourth outer surface 624. The resilient urging member 625 is expandable and shrinkable in the third direction. A coil spring is a typical example of the resilient urging member 625.

The resilient urging member 625 has one end portion in the third direction connected to the first holder member 621, and has another end portion in the third direction connected to the second holder member 622. Length in the third direction of the resilient urging member 625 is changed in accordance with a change in distance in the third direction between the third outer surface 623 and the fourth outer surface 624.

Further, the first holder member 621 includes a holder protrusion 626. The holder protrusion 626 protrudes in the first direction toward one side from one end in the first direction of the first holder member 621. As illustrated in FIG. 3, the holder protrusion 626 extends throughout the opening 160 of the first cover 16. The holder 62 is movable along with the case 10 and the first cover 16 in the first direction, the second direction, and the third direction.

Here, the opening 160 has a dimension (inside dimension) in the second direction greater than a dimension (outside dimension) in the second direction of the holder protrusion 626. Further, the opening 160 has a dimension (inside dimension) in the third direction greater than a dimension (outside dimension) in the third direction of the holder protrusion 626. Hence, the holder protrusion 626 is movable inside the opening 160 in the second direction and third direction. Accordingly, the holder 62 is movable in the second direction and the third direction relative to the case 10 and the first cover 16.

Incidentally, only the electrical contact surface 611 of the IC chip 61 may be held to the holder 62. In this case, a portion of the IC chip 61 other than the electrical contact surface 611 may be held to the outer surface of the first cover 16 or the outer surface of the case 10.

4. Attaching Operation of Developing Cartridge

Next, attaching operation of the developing cartridge 1 to the drawer 2 will be described.

The case 10 is at a first position relative to the drawer 2 when the developing cartridge 1 is mounted on the holding portion 210 of the drawer 2. Thereafter, the developing cartridge 1 is moved from the first position to the second position when the case 10 is pressed in the second direction toward one side. That is, the case 10 of the developing cartridge 1 is movable from the first position to the second position relative to the drawer 2. The developing roller 30 is separated from the photosensitive drum 22 when the developing cartridge 1 is at the first position relative to the drawer 2. The developing roller 30 is in contact with the photosensitive drum 22 when the developing cartridge 1 is at the second position relative to the drawer 2.

Figure 5:
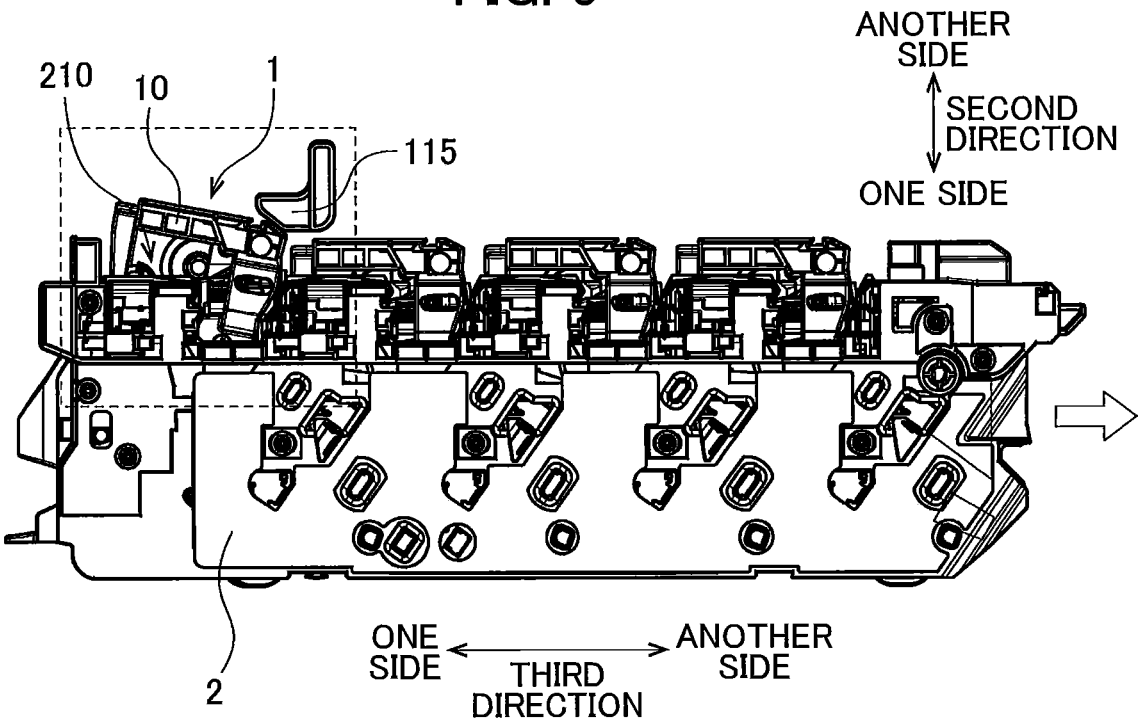
FIG. 5 is a side view illustrating four developing cartridges, the drawer, and a pressure portion provided at a housing of the image forming apparatus according to the embodiment.
Figure 8:
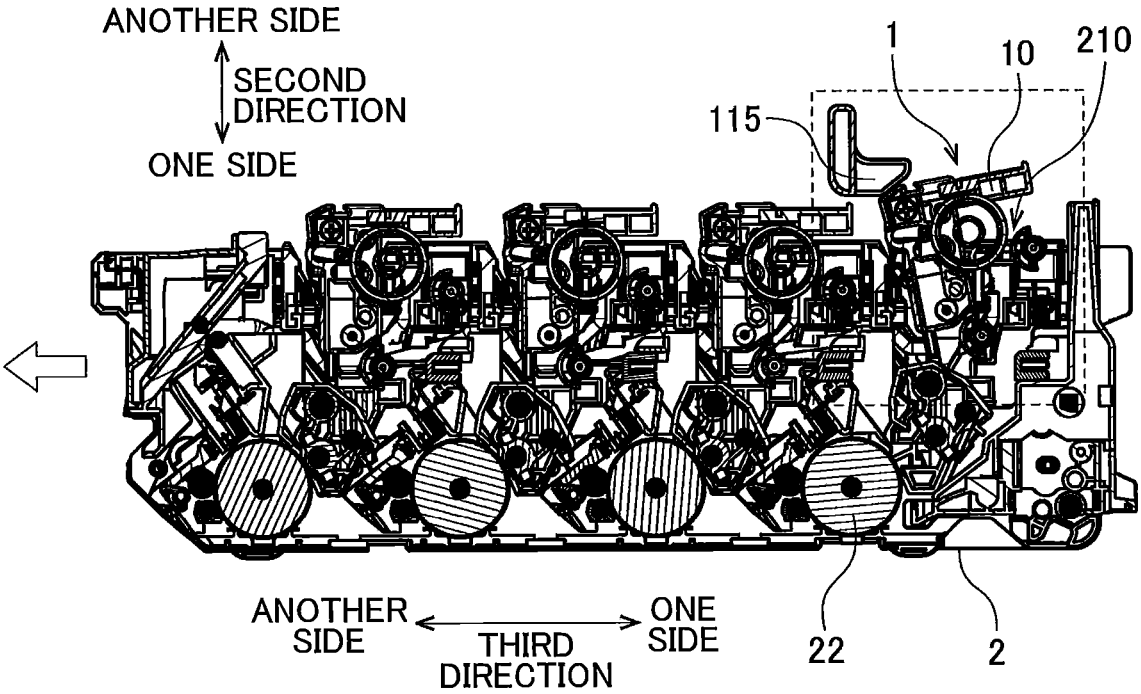
FIG. 8 is a cross-sectional view taken along a line VIII-VIII in FIG. 7 and as viewed in a direction indicated by an arrow A in FIG. 7.
Figure 9:
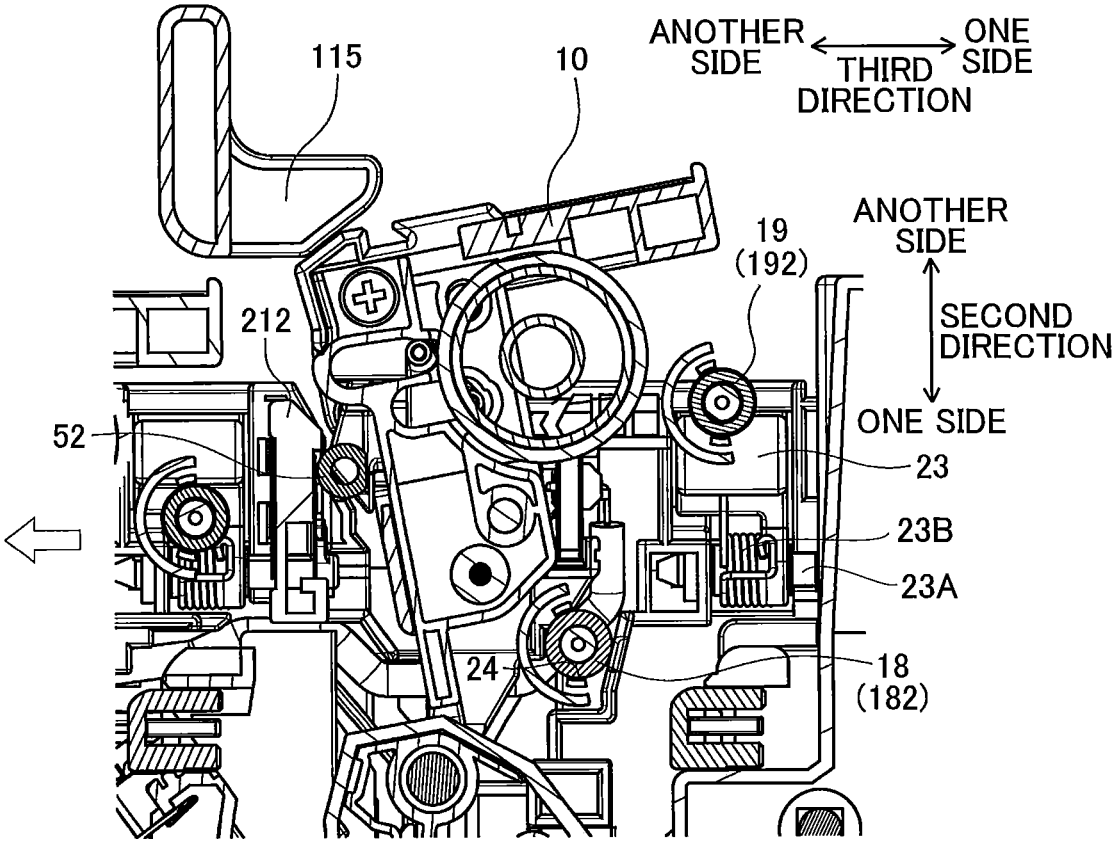
FIG. 9 is an enlarged view of a portion in FIG. 8 encircled by broken line.

FIG. 5 is a side view illustrating four developing cartridges 1, the drawer 2, and the pressure portion 115 provided at the housing 110. FIG. 6 is an enlarged view of a portion in FIG. 5 encircled by broken line. FIG. 7 is a view of the four developing cartridges 1, the drawer 2 and the pressure portion 115 those illustrated in FIG. 5 and as viewed from one side in the third direction. FIG. 8 is a cross-sectional view taken along a line VIII-VIII in FIG. 7 and as viewed in a direction indicated by an arrow A in FIG. 7. FIG. 9 is an enlarged view of a portion in FIG. 8 encircled by broken line.

FIG. 5 is a side view illustrating four developing cartridges 1, the drawer 2, and the pressure portion 115 provided at the housing 110. FIG. 6 is an enlarged view of a portion in FIG. 5 encircled by broken line. FIG. 7 is a view of the four developing cartridges 1, the drawer 2 and the pressure portion 115 those illustrated in FIG. 5 and as viewed from one side in the third direction. FIG. 8 is a cross-sectional view taken along a line VIII-VIII in FIG. 7 and as viewed in a direction indicated by an arrow A in FIG. 7. FIG. 9 is an enlarged view of a portion in FIG. 8 encircled by broken line.

A process of inserting the drawer 2 into the housing 110 of the image forming apparatus 100 is illustrated in FIGS. 5 through 9, wherein the plurality of developing cartridges 1 are mounted on the drawer 2. In FIGS. 5, 6, 8 and 9, the inserting direction of the drawer 2 is indicated by an arrow. Regarding the three of four developing cartridges 1, the cases 10 are at the second position relative to the drawer 2, and the trailing end cartridge 1 (leftmost cartridge 1 in FIG. 5) is at the first position relative to the drawer 2. The following description pertains to the trailing end developing cartridge 1.

4-1. Condition of Each Component in the First Position

Condition of each component of the developing cartridge 1 when the case 10 of the developing cartridge 1 is at the first position will be described with reference to FIGS. 5 through 9.

As illustrated in FIGS. 5 and 6, when the position of the case 10 relative to the drawer 2 is the first position, the holder 62 of the IC chip assembly 60 is in contact with a part of the first side frame 211. Specifically, the third outer surface 623 of the holder 62 is in contact with the first guide surface 26 of the first side frame 211, and the fourth outer surface 624 of the holder 62 is in contact with the second guide surface 27 of the first side frame 211.

Here, a distance between the first guide surface 26 and the second guide surface 27 in the third direction is smaller than a distance between the third outer surface 623 and the fourth outer surface 624 in the third direction of the holder 62 in a state prior to the contact of the holder 62 with the first side frame 211. As a result, in the first position of the case 10, the resilient urging member 625 is compressed, and the distance between the third outer surface 623 and the fourth outer surface 624 in the third direction of the holder 62 is smaller than the distance prior to the contact of the holder with the first side frame 211.

Further, in the first position of the case 10, the electrical contact surface 611 of the IC chip 61 is not contacted with the plurality of electric terminals 251 of the drawer 2. That is, the electrical contact surface 611 and the plurality of electric terminals 251 are away from each other.

As illustrated in FIGS. 8 and 9, when the case 10 is at the first position relative to the drawer 2, the two first bosses 18 of the developing cartridge 1 are seated on the two support surfaces 24 of the drawer 2. Specifically, the first boss 181 at the first outer surface 11 is in contact with the support surface 24 of the first side frame 211, and the first boss 182 at the second outer surface 12 is in contact with the support surface 24 of the second side frame 212. Hence, weight of the developing cartridge 1 is supported by the two support surfaces 24.

Further, as illustrated in FIGS. 8 and 9, when the case 10 is at the first position relative to the drawer 2, the two second bosses 19 of the developing cartridge 1 is in contact with the lock levers 23 which is at the lock position. That is, the second boss 191 at the first outer surface 11 is in contact with the lock lever 23 at the first side frame 211, and the second boss 192 at the second outer surface 12 is in contact with the lock lever 23 at the second side frame 212. That is, only the weight of the developing cartridge 1 is insufficient for pivotally moving the lock levers 23 to the release position against the urging force of the resilient urging member 23B.

Further, as illustrated in FIGS. 8 and 9, when the case 10 is at the first position relative to the drawer 2, the second cam 52 of the separation cam 50 is in contact with a part of the second side frame 212 of the drawer 2. Further, the first cam 51 is in contact with a part of the first side frame 211 of the drawer 2.

In this way, when the case 10 is at the first position relative to the drawer 2, the one end portion in the first direction of the developing cartridge 1 is in contact with three components, i.e., the first boss 181, the second boss 191, and the first cam 51. Further, the other end portion in the first direction of the developing cartridge 1 is in contact with three components, i.e., the first boss 182, the second boss 192, and the second cam 52. Accordingly, the position of the case 10 relative to the drawer 2 can be fixed to the first position.

4-2. Pressing Operation by Pressure Portion

For attaching the drawer 2 to which the developing cartridges 1 are attached to the housing 110, the drawer 2 moves in the third direction from the position outside of the housing 110 to the internal space 111 of the housing 110 through the insertion opening 112. During this movement, as illustrated in FIGS. 5 through 9, the pressure portion 115 provided at the housing 110 contacts the developing cartridges 1 when the case 10 is at the first position relative to the drawer 2.

As illustrated in FIG. 7, for attaching the drawer 2 to the housing 110 while the case 10 is at the first position, the first pressure portion 116 contacts the first pressure receiving surface 161, and the second pressure portion 117 contacts the second pressure receiving surface 171 in accordance with the operation or movement of the drawer 2. Hence, the case 10 is urged in the second direction toward the one side. As a result, case 10 is moved from the first position to the second position.

That is, the first pressure receiving surface 161 receives pressure applied from the first pressure portion 116, and the second pressure receiving surface 171 receives pressure applied from the second pressure portion 117.

In this way, in the depicted embodiment, two portions of the developing cartridge 1 spaced away from each other in the first direction are pressed. Thus, position of the case 10 relative to the drawer 1 can be moved from the first position to the second position while restraining inclination of the developing cartridge 1.

Here, the first pressure portion 116 and the second pressure portion 117 may not press the first cover 16 and the second cover 17, but may press the outer surface of the case 10, the outer surface being at another side in the second direction. Further, only one pressure portion 115 may be provided instead of two pressure portions 116, 117. Alternatively, not less than three pressure portions may be provided. In summary, in the developing cartridge 1, the pressure receiving surface needs to be positioned opposite to the developing roller 30 in the second direction, and the pressure receiving surface needs to be contacted with the pressure portion in accordance with the movement of the drawer 2.

The case 10 is at an intermediate position during the process of changing the position of the case 10 from the first position to the second position. During this process, the lock levers 23 is pressed by the second bosses 19, so that the lock lever 23 is pivotally moved from the lock position to the released position against the urging force of the resilient urging member 23B. When the case 10 is brought to the intermediate position, the lock levers 23 is at the release position.

In accordance with further movement of the case 10 from the intermediate position toward the second position, the second bosses 19 moves past the lock lever 23 in the second direction toward the one side, so that the lock levers 23 is pivotally moved from the released position to the lock position by the urging force of the resilient urging member 23B.

As described above, when the lock levers 23 is at the released position, the lock levers 23 protrudes outward from the drawer frame 21 in the first direction. Specifically, the lock lever 23 positioned at the first side frame 211 protrudes outward of the first side frame 211 in the first direction toward the one side. Further, the lock lever 23 positioned at the second side frame 212 protrudes outward of the second side frame 212 in the first direction toward another side.

However, as described above, the pressure portion 115 protrudes outward of the housing 110 from the edge of the insertion opening 112 in the third direction toward the one side (see FIG. 1). Therefore, the pressure portion 115 can apply pressure to the case 10 so that the second bosses 19 can apply pressure to the lock levers 23 before the lock levers 23 moves past the insertion opening 112. That is, pivotal movement of the lock levers 23 from the lock position to the released position and then to the lock position can be completed before the lock levers 23 moves past the insertion opening 112. Therefore, mechanical interference between the housing 110 and the lock levers 23 at its released position can be obviated, and the lock levers 23 can be pivotally moved from the lock position to the release position and again to the lock position.

Further, when the case 10 is moved from the intermediate position to the lock position, the lock levers 23 presses the second bosses 19 in the second direction toward the one side. Hence, the case 10 is pivotally moved about the axis of the first bosses 18. As a result, the electrical contact surface 611 of the IC chip 61 approaches the electric terminal 251 of the drawer 2.

4-3. Condition of Each Components in Second Position

Figure 10:
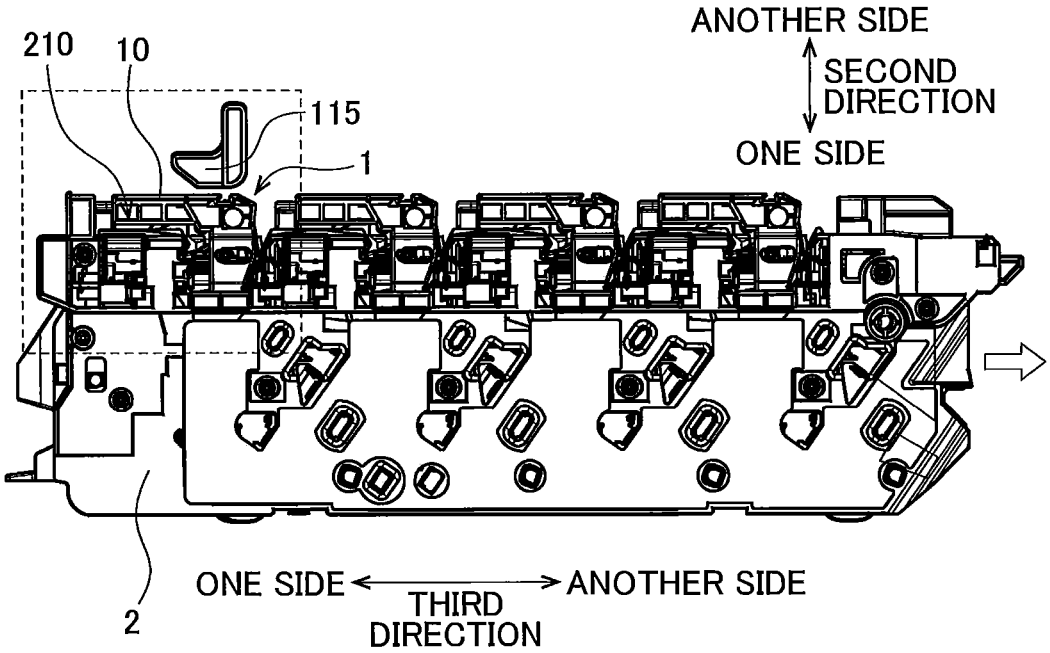
FIG. 10 is another side view illustrating the four developing cartridges, the drawer, and the pressure portion.
Figure 11:
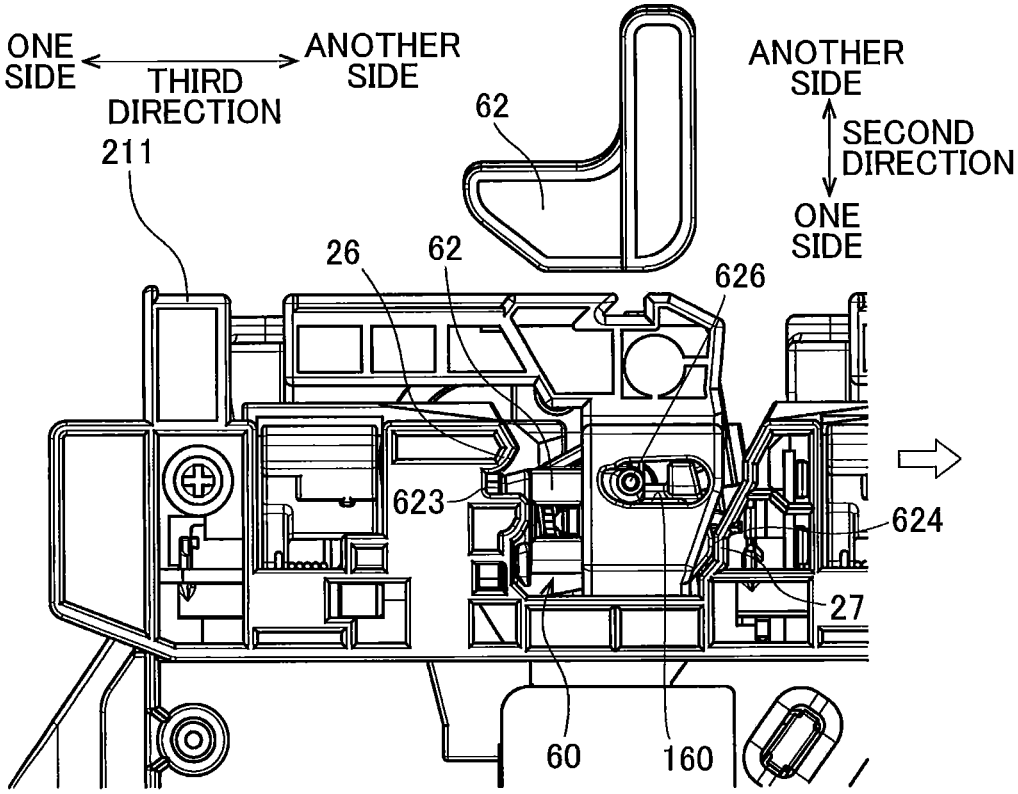
FIG. 11 is an enlarged view of a portion in FIG. 10 encircled by broken line.
Figure 12:
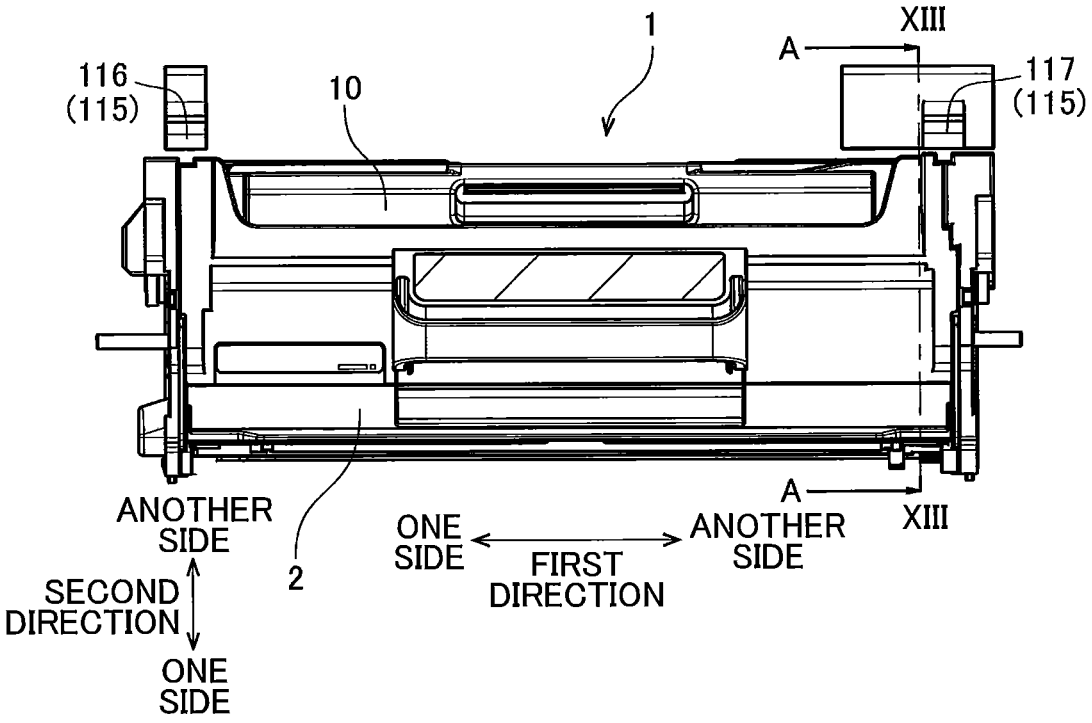
FIG. 12 is a view of the four developing cartridges, the drawer and the pressure portion those illustrated in FIG. 10 and as viewed from one side in the third direction.
Figure 13:
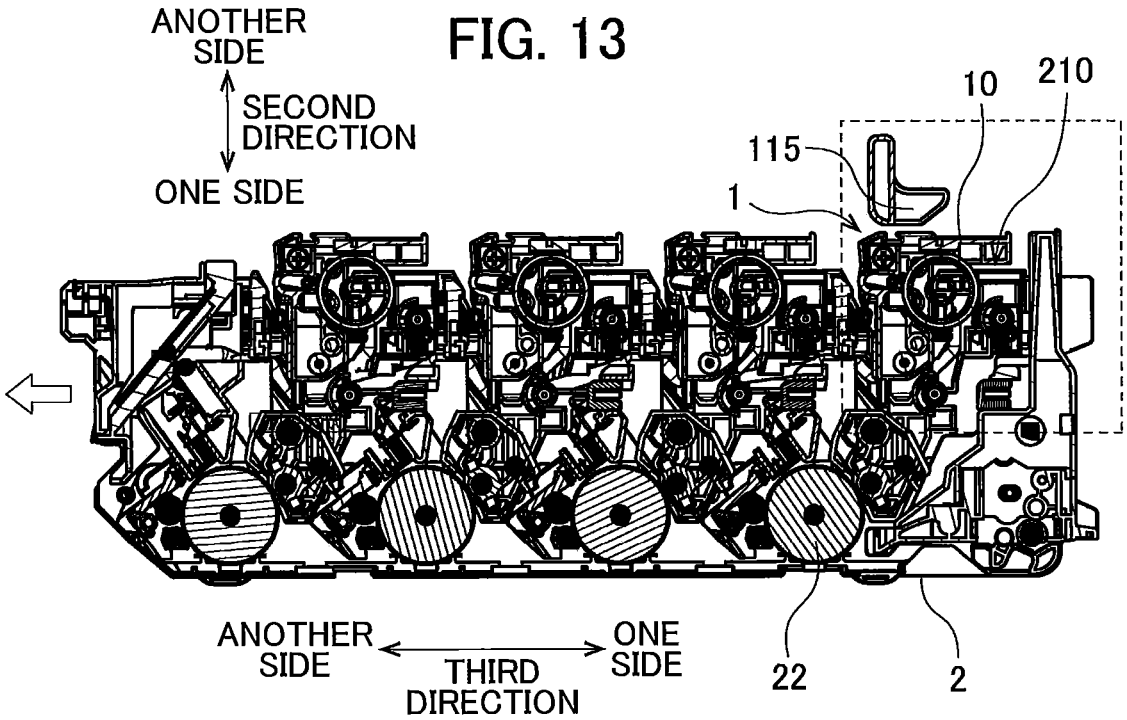
FIG. 13 is a cross-sectional view taken along a line XIII-XIII in FIG. 12 and as viewed in the direction indicated by the arrow A in FIG. 12.
Figure 14:
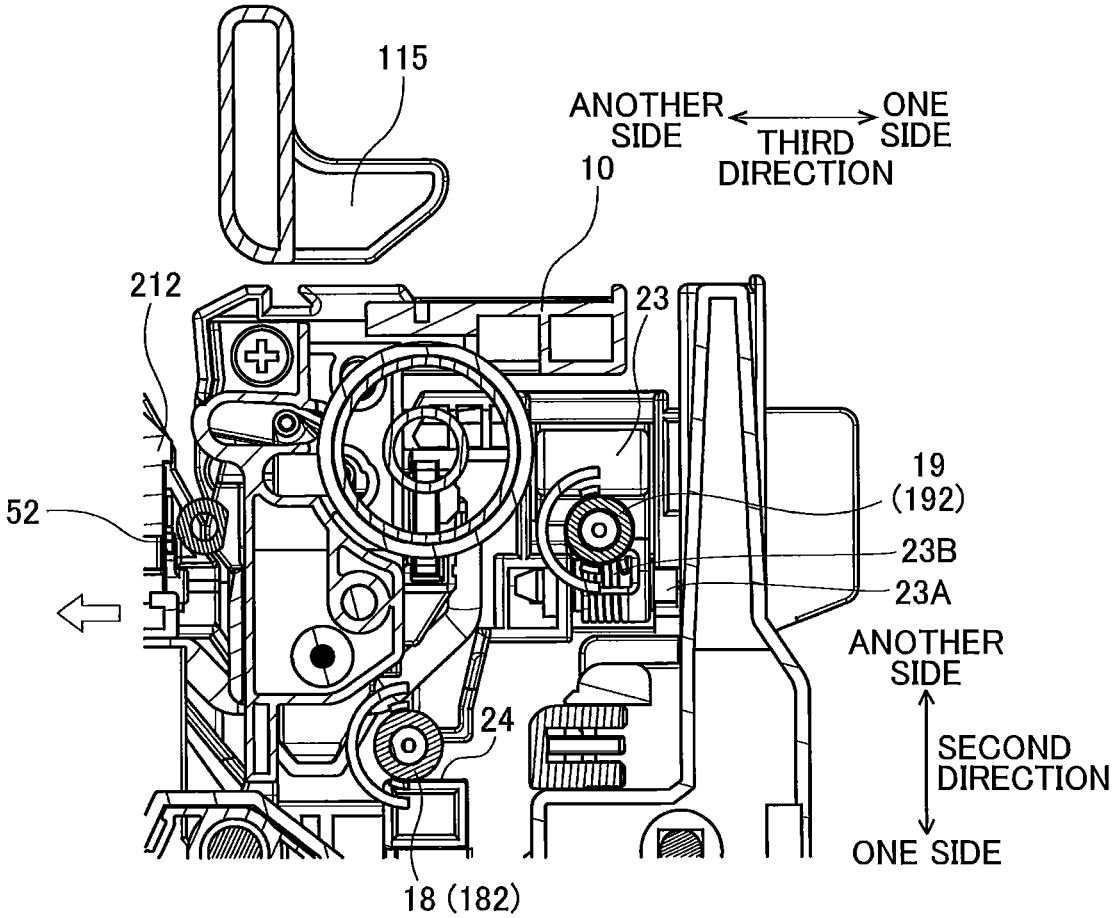
FIG. 14 is an enlarged view of a portion in FIG. 13 encircled by broken line.

FIG. 10 is another side view illustrating the four developing cartridges 1, the drawer 2 and the pressure portion 115 of the housing 110. FIG. 11 is an enlarged view of a portion in FIG. 10 encircled by broken line. FIG. 12 is a view of the four developing cartridges 1, the drawer 2 and the pressure portion 115 those illustrated in FIG. 10 and as viewed from one side in the third direction. FIG. 13 is a cross-sectional view taken along a line XIII-XIII in FIG. 12 and as viewed in the direction indicated by the arrow A in FIG. 12. FIG. 14 is an enlarged view of a portion in FIG. 13 encircled by broken line.

As illustrated in FIGS. 10 and 11, the distance between the third outer surface 623 and the fourth outer surface 624 of the holder 62 in the third direction in a case where the case 10 is at the second position relative to the drawer 2 is shorter than the distance in a case prior to contact of the holder 62 with the first side frame 211, and is longer than the distance in a case where the case 10 is at the first position relative to the drawer 2.

That is, when the case 10 moves from the first position to the second position relative to the drawer 2, the resilient urging member 625 of the holder 62 expands in the third direction. As a result, the electrical contact surface 611 of the IC chip 61 is brought into contact with the plurality of electric terminals 251 of the drawer 2.

In this way, according to the image forming apparatus 100, the case 10 of the developing cartridge 1 is moved from the first position to the second position in accordance with the movement of the drawer 2, whereupon the electrical contact surface 611 of the IC chip 61 can be brought into contact with the plurality of electric terminals 251 of the drawer 2. Accordingly, electrical contact between the electrical contact surface 611 of the IC chip 61 and the plurality of electric terminals 251 of the drawer 2 can be attained even in a case where the drawer 2 is aimed to be attached to the housing 110 while the case 10 remains at the first position relative to the drawer 2.

Further, as illustrated in FIGS. 13 and 14, the first bosses 18 remains the contact with the support surfaces 24 of the drawer 2 in the case where the case 10 is at the second position relative to the drawer 2. Specifically, the first boss 181 at the first outer surface 11 remains contacting with the support surface 24 of the first side frame 211, and the first boss 182 at the second outer surface 12 remains contacting with the support surface 24 of the second side frame 212. That is, the weight of the developing cartridge 1 can be continuously supported by the support surface 24.

In this way, according to the image forming apparatus 100, the case 10 can be pivotally movable about the axis of the first boss 18 in accordance with the movement of the case 10 from the first position to the second position caused by the movement of the drawer 2, while the weight of the developing cartridge 1 is supported by the support surface 24. Hence, pivotal movement of the case 10 about the axis of the first boss 18 can be performed even in the case where the drawer 2 is aimed to be attached to the housing 110 while the case 10 is at the first position relative to the drawer 2.

Further, as illustrated in FIGS. 13 and 14, the two second bosses 19 are positioned at one side in the second direction of the lock levers 23 when the case 10 is at the second position. Specifically, the second boss 19 at the first outer surface 11 is positioned at one side in the second direction of the lock lever 23 at the first side frame 211, and the second boss 19 at the second outer surface 12 is positioned at one side in the second direction of the lock lever 23 at the second side frame 212. At this time, each lock lever 23 is at the lock position.

In this way, according to the image forming apparatus 100, the case 10 is moved from the first position to the second position in accordance with the movement of the drawer 2, and hence, the lock levers 23 can be pivotally moved from the lock position to the release position and again to the lock position. Therefore, the developing cartridge 1 can be locked by the pivotal movement of the lock levers 23 when the drawer 2 is to be attached to the housing 110 while the case 10 is at the first position.

Further, as illustrated in FIGS. 13 and 14, the second cam 52 of the separation cam 50 is separated from the second side frame 212 of the drawer 2 when the case 10 is at the second position. In a similar way, the first cam 51 of the separation cam 50 is separated from the first side frame 211 of the drawer 2 when the case 10 is at the second position. In this way, according to the image forming apparatus 100, movement of the case 10 from the first position to the second position caused by the movement of the drawer 2 can permit the first cam 51 and the second cam 52 to move to the non-contacting position with the drawer frame 21. Accordingly, the first cam 51 and the second cam 52 can be moved to the predetermined position out of contact with the drawer frame 21 even in the case where the drawer 2 is to be attached to the housing 110 while the case 10 remains at the first position.

While the description has been made in detail with reference to the specific embodiment, it would be apparent to those skilled in the art that various changes and modifications may be made therein without departing from the scope and spirit of the disclosure.

What is claimed is:

1. A developing cartridge for use with a drawer including a photosensitive drum and an electric terminal, the developing cartridge comprising:

a casing configured to accommodate developing agent therein;

a developing roller rotatable about an axis extending in a first direction, the developing roller being movable with the casing;

a storage medium having an electrical contact surface; and a holder holding the electrical contact surface, and movable with the casing;

wherein the casing is movable relative to the drawer from a first position in which the developing roller is separated from the photosensitive drum and the electrical contact surface is separated from the electric terminal to a second position in which the developing roller is in contact with the photosensitive drum and the electrical contact surface is in contact with the electric terminal, and wherein the casing is movable relative to the drawer from the first position to the second position in accordance with the movement of the drawer for attaching the drawer to a housing of an image forming apparatus.

2. The developing cartridge according to claim 1, wherein a portion of the casing is in contact with the housing in a case where the drawer is attached to the housing of the image forming apparatus, and wherein the casing movable relative to the drawer from the first position to the second position after the portion of the casing is in contact with the housing.

3. The developing cartridge according to claim 2, wherein the casing has a pressure receiving surface positioned at a position opposite to the developing roller in a second direction crossing the first direction, the pressure receiving surface being in contact with the housing in a case where the drawer is attached to the housing of the image forming apparatus.

4. The developing cartridge according to claim 3, wherein the pressure receiving surface comprises:

a first pressure receiving surface positioned closer to one side of the casing in the first direction than a center of the casing in the first direction; and a second pressure receiving surface positioned closer to another side of the casing in the first direction than the center of the casing in the first direction.

5. The developing cartridge according to claim 4, wherein the casing includes:

a first outer surface positioned at the one side of the casing in the first direction, a second outer surface positioned at the another side of the casing in the first direction;

a first cover covering the first outer surface; and a second cover covering the second outer surface, wherein the first pressure receiving surface is an outer surface of the first cover, and wherein the second pressure receiving surface is an outer surface of the second cover.

6. The developing cartridge according to claim 5, wherein the holder is positioned at the first outer surface of the casing.

7. The developing cartridge according to claim 1, wherein the holder is movable relative to the casing in a direction crossing the electrical contact surface.

8. The developing cartridge according to claim 1, further comprising a separation cam movable in the first direction relative to the casing, and movable together with the casing relative to the photosensitive drum in a direction crossing the first direction;

wherein the separation cam is in contact with a frame of the drawer in a case where the casing is at the first position, and wherein the separation cam is separable from the frame in a case where the casing is at the second position.

9. The developing cartridge according to claim 8, wherein the developing roller is movable from a contact position in which the developing roller is in contact with the photosensitive drum to a separated position in which the developing roller is separated from the photosensitive drum in accordance with the movement of the separation cam to the first direction in a case where the casing is at the second position.

10. The developing cartridge according to claim 1, further comprising a first boss extending in the first direction from the casing, wherein the drawer has a support surface configured to allow the first boss to be seated and configure to receive a weight of the developing cartridge, wherein the first boss is seated on the support surface in a case where the casing is at the first position, and wherein the casing is pivotally movable from the first position to the second position about the first boss.

11. The developing cartridge according to claim 10, wherein the drawer includes:

a lock lever pivotally movable about a third axis crossing the first direction between a lock position and a released position in which the lock lever is positioned outward of the frame in the first direction relative to the lock position of the lock lever, wherein the developing cartridge further includes:

a second boss extending in the first direction, the second boss being positioned farther from the developing roller than the first boss is from the developing roller, the second boss being contactable with the lock lever, wherein the second boss is in contact with the lock lever and the lock lever is at the lock position in a case where the casing is at the first position, wherein the lock lever is pressed by the second boss to move the lock lever to the released position in a case where the casing is at an intermediate position between the first position and the second position, and wherein the lock lever is at the lock position in a case where the casing is at the second position.

12. An image forming apparatus comprising:

the drawer according to claim 1; and a housing to which the drawer is attachable.

13. The image forming apparatus according to claim 12, wherein the housing comprising a pressure portion, the pressure portion being contactable with the casing in accordance with the movement to the drawer.

14. The image forming apparatus according to claim 13, wherein the housing has an insertion opening through which the drawer passes in a case where the drawer is attached to the housing of the image forming apparatus;

wherein the pressure portion is positioned at an edge of the insertion opening.

15. The image forming apparatus according to claim 14, wherein the pressure portion protrudes outward of the housing from the edge of the insertion opening.

16. The developing cartridge according to claim 1, further comprising: a pair of first bosses, a pair of second bosses, and a separation cam, each of the pair of first bosses extending in the first direction, each of the pair of second bosses extending in the first direction, the separation cam including a first cam and a second cam, the separation cam being movable in the first direction relative to the casing, wherein one of the pair of first bosses is provided at one of a pair of opposite sides of the casing in the first direction, and another one of the pair of first bosses is provided at another one of the pair of opposite sides of the casing in the first direction, wherein one of the pair of second bosses is provided at the one of the pair of opposite sides of the casing in the first direction, and another one of the pair of second bosses is provided at the another one of the pair of opposite sides of the casing in the first direction, and wherein the first cam is provided at the one of the pair of opposite sides of the casing in the first direction, and the second cam is provided at the another one of the pair of opposite sides of the casing in the first direction.

17. A developing cartridge for use with a drawer including a frame and photosensitive drum, the developing cartridge comprising:

a casing configured to accommodate developing agent therein;

a developing roller rotatable about an axis extending in a first direction, the developing roller being movable with the casing; and a separation cam movable in the first direction relative to the casing, and movable together with the casing relative to the photosensitive drum in a direction crossing the first direction;

wherein the casing is movable relative to the drawer in accordance with movement of the drawer from a first position in which developing roller is separated from the photosensitive drum and the separation cam is in contact with a frame of the drawer to a second position in which the developing roller is in contact with the photosensitive drum and the separation cam is separated from the frame of the drawer.

18. The developing cartridge according to claim 17, wherein the movement of the drawer is for attaching the drawer to a housing of an image forming apparatus, and wherein the casing is movable relative to the drawer from the first position to the second position in a case where the drawer is attached to the housing.

19. The developing cartridge according to claim 18, wherein a portion of the casing is in contact with the housing in a case where the drawer is attached to the housing of the image forming apparatus, and wherein the casing movable relative to the drawer from the first position to the second position after the portion of the casing is in contact with the housing.

20. The developing cartridge according to claim 19, wherein the casing has a pressure receiving surface being positioned at a position opposite to the developing roller in a second direction crossing the first direction, the pressure receiving surface being in contact with the housing in a case where the drawer is attached to the housing of the image forming apparatus.

21. The developing cartridge according to claim 20, wherein the pressure receiving surface comprises:

a first pressure receiving surface positioned closer to one side of the casing in the first direction than a center of the casing in the first direction; and a second pressure receiving surface positioned closer to another side of the casing in the first direction than the center of the casing in the first direction.

22. The developing cartridge according to claim 21, wherein the casing includes:

a first outer surface positioned at the one side of the casing in the first direction, a second outer surface positioned at the another side of the casing in the first direction;

a first cover covering the first outer surface; and a second cover covering the second outer surface, wherein the first pressure receiving surface is an outer surface of the first cover, and wherein the second pressure receiving surface is an outer surface of the second cover.

23. The developing cartridge according to claim 17, wherein the developing roller is movable from a contact position in which the developing roller is in contact with the photosensitive drum to a separated position in which the developing roller is separated from the photosensitive drum in accordance with the movement of the separation cam to the first direction in a case where the casing is at the second position.

24. The developing cartridge according to claim 17, further comprising a first boss extending in the first direction from the casing, wherein the drawer has a support surface configured to allow the first boss to be seated and configure to receive a weight of the developing cartridge, wherein the first boss is seated on the support surface in a case where the casing is at the first position, and wherein the casing is pivotally movable from the first position to the second position about the first boss.

25. The developing cartridge according to claim 24, wherein the drawer includes:

a lock lever pivotally movable about a third axis crossing the first direction between a lock position and a released position in which the lock lever is positioned outward of the frame in the first direction relative to the lock position of the lock lever, wherein the developing cartridge further includes:

a second boss extending in the first direction, the second boss being positioned farther from the developing roller than the first boss is from the developing roller, the second boss being contactable with the lock lever, wherein the second boss is in contact with the lock lever and the lock lever is at the lock position in a case where the casing is at the first position, wherein the lock lever is pressed by the second boss to move the lock lever to the released position in a case where the casing is at an intermediate position between the first position and the second position, and wherein the lock lever is at the lock position in a case where the casing is at the second position.

26. An image forming apparatus comprising:

the drawer according to claim 17; and a housing to which the drawer is attachable.

27. The developing cartridge according to claim 17, further comprising: a pair of first bosses and a pair of second bosses, each of the pair of first bosses extending in the first direction, each of the pair of second bosses extending in the first direction, the separation cam including a first cam and a second cam, wherein one of the pair of first bosses is provided at one of a pair of opposite sides of the casing in the first direction, and another one of the pair of first bosses is provided at another one of the pair of opposite sides of the casing in the first direction, wherein one of the pair of second bosses is provided at the one of the pair of opposite sides of the casing in the first direction, and another one of the pair of second bosses is provided at the another one of the pair of opposite sides of the casing in the first direction, and wherein the first cam is provided at the one of the pair of opposite sides of the casing in the first direction, and the second cam is provided at the another one of the pair of opposite sides of the casing in the first direction.

28. A developing cartridge for use with a drawer including a photosensitive drum, the developing cartridge comprising:

a casing configured to accommodate developing agent therein;

a developing roller rotatable about an axis extending in a first direction, the developing roller being movable with the casing; and a first boss extending in the first direction, the first boss having a cylindrical shape;

wherein the drawer has a support surface configured to allow the first boss to be seated and configure to receive a weight of the developing cartridge, and wherein the casing is pivotally movable about the first boss relative to the drawer from a first position in which the developing roller is separated from the photosensitive drum and the first boss is in contact with the support surface to a second position in which the developing roller is in contact with the photosensitive drum, and wherein the casing is movable relative to the drawer from the first position to the second position in accordance with the movement of the drawer to a housing of an image forming apparatus.

29. The developing cartridge according to claim 28, wherein a portion of the casing is in contact with the housing in a case where the drawer is attached to the housing of the image forming apparatus, and wherein the casing movable relative to the drawer from the first position to the second position after the portion of the casing is in contact with the housing.

30. The developing cartridge according to claim 29, wherein the casing has a pressure receiving surface being positioned at a position opposite to the developing roller in a second direction crossing the first direction, the pressure receiving surface being in contact with the housing in a case where the drawer is attached to the housing of the image forming apparatus.

31. The developing cartridge according to claim 30, wherein the pressure receiving surface comprises:

a first pressure receiving surface positioned closer to one side of the casing in the first direction than a center of the casing in the first direction; and a second pressure receiving surface positioned closer to another side of the casing in the first direction than the center of the casing in the first direction.

32. The developing cartridge according to claim 31, wherein the casing includes:

a first outer surface positioned at the one side of the casing in the first direction, a second outer surface positioned at the another side of the casing in the first direction;

a first cover covering the first outer surface; and a second cover covering the second outer surface, wherein the first pressure receiving surface is an outer surface of the first cover, and wherein the second pressure receiving surface is an outer surface of the second cover.

33. The developing cartridge according to claim 28, wherein the drawer includes:

a lock lever pivotally movable about a third axis crossing the first direction between a lock position and a released position in which the lock lever is positioned outward of the frame in the first direction relative to the lock position of the lock lever, wherein the developing cartridge further includes:

a second boss extending in the first direction, the second boss being positioned farther from the developing roller than the first boss is from the developing roller, the second boss being contactable with the lock lever, wherein the second boss is in contact with the lock lever and the lock lever is at the lock position in a case where the casing is at the first position, and wherein the lock lever is pressed by the second boss to move the lock lever to the released position in a case where the casing is at an intermediate position between the first position and the second position, and wherein the lock lever is at the lock position in a case where the casing is at the second position.

34. An image forming apparatus comprising:

the drawer according to claim 28; and a housing to which the drawer is attachable.

35. The developing cartridge according to claim 28, further comprising: a pair of first bosses, a pair of second bosses, and a separation cam, the pair of first bosses including the first boss, each of the pair of first bosses extending in the first direction, each of the pair of second bosses extending in the first direction, the separation cam including a first cam and a second cam, the separation cam being movable in the first direction relative to the casing, wherein one of the pair of first bosses is provided at one of a pair of opposite sides of the casing in the first direction, and another one of the pair of first bosses is provided at another one of the pair of opposite sides of the casing in the first direction, wherein one of the pair of second bosses is provided at the one of the pair of opposite sides of the casing in the first direction, and another one of the pair of second bosses is provided at the another one of the pair of opposite sides of the casing in the first direction, and wherein the first cam is provided at the one of the pair of opposite sides of the casing in the first direction, and the second cam is provided at the another one of the pair of opposite sides of the casing in the first direction.

* * * * *